United States Patent [19]

McCormick

[11] Patent Number: 5,012,722

[45] Date of Patent: May 7, 1991

[54] FLOATING COIL SERVO VALVE

[75] Inventor: Joseph F. McCormick, Holyoke, Mass.

[73] Assignee: International Servo Systems, Inc., Newport, R.I.

[21] Appl. No.: 432,978

[22] Filed: Nov. 6, 1989

[51] Int. Cl.[5] ..... F15B 9/03; F15B 13/044

[52] U.S. Cl. ..... 91/361; 91/433; 91/459; 137/625.65; 251/129.01

[58] Field of Search ..... 91/361, 433, 459; 137/625.65; 251/129.01

[56] References Cited

U.S. PATENT DOCUMENTS

| | | | |
|---|---|---|---|
| 2,750,961 | 6/1956 | Uritis | 251/129.05 X |
| 3,840,045 | 10/1974 | Grosseau | 137/625.65 X |
| 4,040,445 | 8/1977 | McCormick | 137/625.65 X |
| 4,464,978 | 8/1984 | Ichiryu et al. | 91/459 |
| 4,544,129 | 10/1985 | Ichiryu et al. | 251/129.01 |
| 4,628,499 | 12/1986 | Hammett | 364/167 |
| 4,714,005 | 12/1987 | Leemhuis | 91/361 |
| 4,741,247 | 5/1988 | Glomeau et al. | 91/361 |
| 4,817,498 | 4/1989 | Takagi | 91/361 |

*Primary Examiner*—Gerald A. Michalsky

*Attorney, Agent, or Firm*—Fish & Richardson

[57] ABSTRACT

An electrohydraulic servo valve employing a linear force motor having a floating coil and armature driven by a high frequency excitation signal modulated to change its average DC component. A servo loop controller modulates the excitation signal in response to feedback signals from the servo valve or a hydraulic actuator controlled by the servo valve.

21 Claims, 5 Drawing Sheets

FLOATING COIL SERVO VALVE

BACKGROUND

This invention relates to electrohydraulic servo valves and control systems for the same.

Typical of such servo valves is the electrical linear force motor actuated hydraulic valve described in U.S. Pat. No. 4,040,445, issued to McCormick, incorporated herein by reference. Traditionally these servo valves have an electronically activated coil and armature that move back and forth linearly against the compliant force of a centering spring or bellows, similar to the operation of a loud speaker. The coil and armature on which it is wound is connected to a valve spool sliding within a valve spool housing. The valve is proportionally opened and closed in response to the electrical voltage applied to the coil, the voltage to valve operation being designed to maintain a linear relationship. The linearity of the coil motion versus applied voltage, and thus the proportional valve operation, is dependent on the linear relationship of the electromagnetic force generated by the coil working against the force of the centering springs, and the friction in the moving parts, especially the valve spool within the valve spool housing. To maintain a predetermined uniform relationship between electrical input and valve opening, the spring forces and mechanical tolerances of the moving parts must be tightly controlled, precisely adjusted and maintained over the life of the valve. These factors dramatically increase production costs while lowering repeatability and reliability. Additionally, the distance and bandwidth over which these counteracting forces are linear is small, therefore severely limiting the use of such valves.

SUMMARY OF THE INVENTION

A general feature of the invention is a servo valve utilizing a free-floating coil linear force motor driving a hydraulic spool valve. The coil of the linear force motor is driven by a high frequency electrical excitation signal means with a variable average DC component in a servo control loop. A preferred embodiment of the excitation means includes a pulse width modulation amplifier with an output signal of variable duty cycle.

Another general aspect of the invention is the servo control loop including a loop controller, an input device, and various feedback elements for detecting the state of the linear force motor and the hydraulic valve. Preferred embodiments of the feedback devices include a linear force motor position sensing coil and a valve position sensing linear variable differential transformer (LVDT).

Another general aspect of the invention is a hydraulic actuator coupled to the servo valve, and various feedback elements for detecting the condition of the actuator for controlling the servo loop. Preferred embodiments of the actuator feedback devices include an actuator differential input pressure transducer, an actuator position transducer, an actuator velocity transducer and an actuator force transducer.

Yet another aspect of the invention is a microprocessor servo loop controller featuring a servo loop program characterized to compensate for servo valve tolerances. Preferred embodiments include a digital signal processor type microprocessor and a servo valve excitation signal update rate of about 1 ms. Other preferred embodiments include an analog multiplexer driving an analog to digital converter connected to the microprocessor for gathering data from various feedback devices. Another preferred embodiment includes a digital to analog converter connected to the microprocessor for driving a pulse width modulation amplifier supplying the electrical excitation signal to the servo valve linear force motor coil.

Without the centering spring the coil has no determined rest or home position. The resulting positional indeterminateness is overcome by the dynamic control of the servo loop which is capable of continuously correcting position by merely offsetting the duty cycle slightly in one direction or the other, as needed to maintain a given position.

The elimination of the centering spring mechanisms in a servo valve while maintaining precise control over the servo valve operation greatly increases the bandwidth of the device, eliminates undesirable resonances, decreases the valve's complexity and allows for larger valve spool displacements. Replacement of the springs with inexpensive electronics lowers manufacturing costs and increases reliability, repeatability and accuracy of operation.

DESCRIPTION OF PREFERRED EMBODIMENTS OF THE INVENTION

The drawings are briefly described as follows.

STRUCTURE

Figure 1:
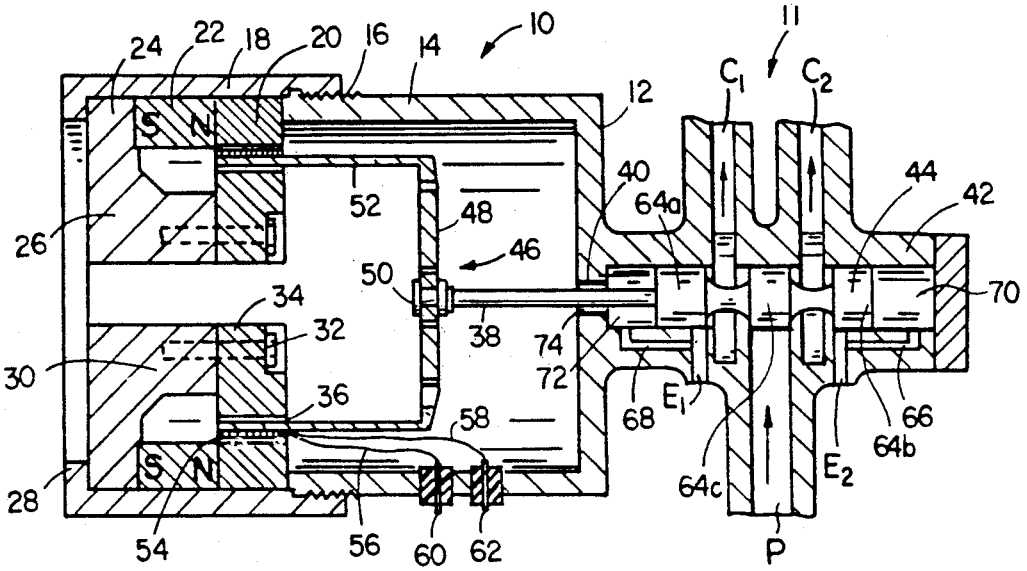
FIG. 1 is a cross-sectional plan view of a servo valve featuring a floating coil linear force motor driving a hydraulic flow valve.

FIG. 1 illustrates an electrohydraulic flow valve assembly, in which the flow of hydraulic fluid through a valve is controlled by an applied electrical signal. The mechanism includes a linear electrical force motor section 10, coupled to a utilization device in the form of a four way fluid valve 11. As illustrated, a single casing 12 houses the portions of both the valve and force motor, although such integral relationship is not significant to the invention.

In the force motor section 10, the casing 12 includes a cylindrical motor housing 14 provided with threads 16 at its open end to receive a threaded cylindrical end cap 18. An annular magnetic pole piece 20 is received within the cap 18, seated against the end of the housing 14. An annular permanent magnet 22 is seated against the annular pole piece 20 and is in contact with the flanges 24 of a magnetic base member 26. The flanges 24 of the base member are engaged by in-turned flanges 28 at the bottom of the cylindrical end cap 18 such that, when the cap is secured tightly on the housing 14, the pole piece 20, magnet 22, and magnetic base 26 are tightly clamped in place. The base 26 is provided with an inwardly projecting cylindrical core 30, to which a disk like section 34 of magnetic material is secured by bolts 32 or other suitable means. This section 34 is positioned concentrically within the annular or outer pole piece 20, and comprises an inner pole piece of the magnetic flux circuit. The two pole pieces 20 and 34 define between them an annular air gap 36 of predetermined width In this respect it will be noted that the permanent magnet element 22 is actually polarized such that the outer pole piece 20 constitutes one pole while the inner pole piece 34 constitutes an opposite pole of the magnetic circuit.

An operating element in the form of a central rod 38 projects through an opening 40 into the valve housing 42, for operating a hydraulic valve spool or plunger 44, as will be described below. A cup-like armature member 46, is received within the housing 14 and has a bottom plate element 48 to which the operating element 38 is anchored at 50. The plate 48 is connected to a cylindrical cup wall 52, which is coaxial with the operating element 38, and the annular air gap 36. The cup wall 52 extends into the air gap, carrying an electrical coil 54 forming part of the linear force motor (LFM). The coil 54 consists of an appropriate number of terms of fine insulated wire wound about the cylindrical armature wall 52 and forms a coaxial coil symmetrically received within the air gap 36. The ends of the coil form leads 56 and 58 connected to terminals 60 and 62 respectively, which are accessible externally of the motor housing 14.

In the device illustrated in FIG. 1, the operating element 38, which is driven by the linear force motor, is connected to the hydraulic valve spool 44 disposed in valve 11. The valve housing 42, within which the spool 44 is slidably guided, includes a pressure inlet port P, a pair of exhaust ports E1, E2, and a pair of control ports C1, C2. Spool 44 has two end lands 64*a* and 64*b* and a central land 64*c*. In the neutral position of the valve spool, as shown in FIG. 1, its central land 64*c* isolates the pressure port P, as well as the exhaust ports E1 and E2, from the two control ports C1 and C2. The end lands 64*a* and 64*b* occlude ports E1 and E2, respectively. However, if the spool 44 is shifted to the right in response to electrical energization of the force motor, the exhaust port E2 is partly opened to the control port C2, and the pressure port P is partly opened to the control port C1, providing for a controlled flow of pressurized fluid from port P to port C1 and a controlled flow of exhaust fluid from the control port C2 to the exhaust port E2. Exhaust port E1 remains blocked by land 64*a*. The flow rate will, of course, be a function of the linear displacement of the valve spool 44, which in turn is a function of the linear displacement of the armature 46 as determined by the electrical signals applied to the LFM coil 54 by means of terminals 60 and 62. Thus, the controlled fluid flow is directly determined by the electrical signals applied to coil 54 as discussed below.

Energization of the LFM coil 54 by an electrical signal that displaces the armature to the left, results in directing pressurized fluid into the control port C2 and permits exhaust fluid to flow from the control port C1 out port E1, with the flow again being controlled by the electrical signals applied to the LFM coil 54.

In the neutral position of the LFM coil 54, as shown in FIG. 1, the valve spool 44 is precisely centered in relation to the various exhaust ports and the pressure ports. To achieve this condition, an electrical signal is applied to maintain the LFM coil 54 in this neutral position as described below.

Unbalanced hydraulic forces on the valve spool 44 are prevented by providing open vent passages 66 and 68 communicating with end chambers 70 and 72 of valve housing, so that there can be no build-up of hydraulic pressure within these chambers. Fluid seal 74 prevents hydraulic fluid from entering the cylindrical motor housing 14.

Figure 2A:
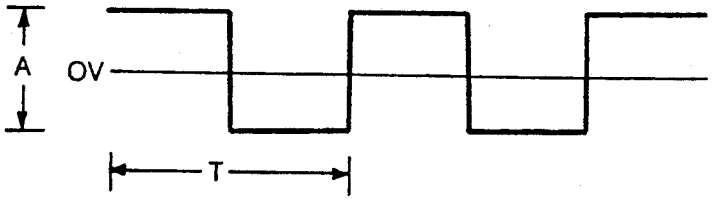
FIG. 2 represents waveforms of a series of pulse width modulated electrical excitation signals for driving the floating coil linear force motor of FIG. 1.

FIGS. 2*a*–2*i* represent the voltage excitation signal applied to the coil terminals 60 and 62 to maintain the position of, or cause deflection of, the armature member 46 within the cylindrical motor housing 14, thereby allowing positioning and deflection of the spool 44 through the action of operating element 38. The construction of the linear force motor allows the LFM coil 54 to "float" within the magnetic flux circuit created by permanent magnet 22 and pole pieces 20, 26 and 34. The LFM coil 54 is excited with a high frequency bipolar signal as shown in FIG. 2*a*. A positive voltage applied from terminal 60 to 62, as we now define, causes a deflection of the LFM coil and armature to the right (as viewed in FIG. 1), and a negative voltage causes deflection to the left. The application of a high frequency bipolar signal with an average DC value of 0 volts has no effect on the present position of LFM coil 54 within the magnetic field. The choice of the frequency is high enough above the mechanical frequency response of the linear force motor so that the balanced changes (50% duty cycle) in signal polarity do not cause an actual deflection in the armature. Rather the armature "floats" within the magnetic field. A typical choice of frequency for the excitation signal is 35 kHz.

Figure 2B:
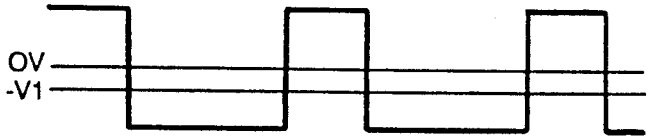
Figure 2D:
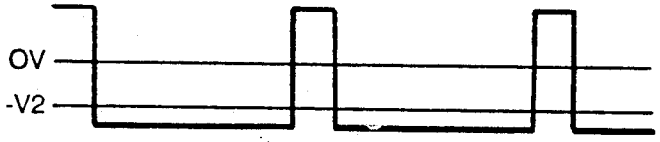
Figure 2F:
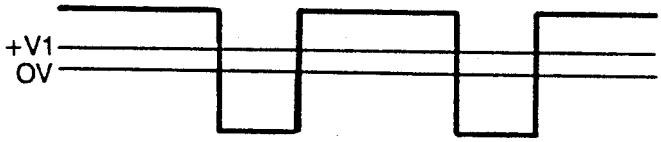
Figure 2H:
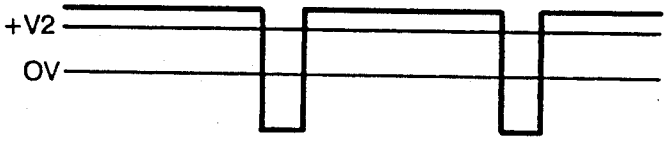
Figure 2C:
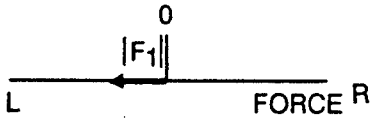
Figure 2G:
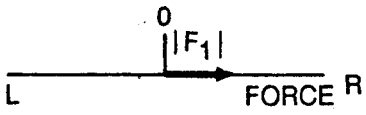
Figure 2E:
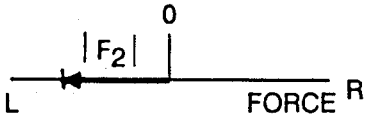
Figure 2I:
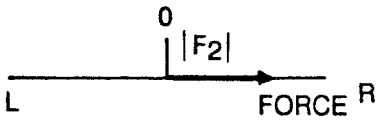

Forced deflection of the LFM coil 54 is achieved by changing the duty cycle to control the average DC value of the high frequency signal applied to the LFM coil. The force of the deflection is controlled by the magnitude of the average () DC value, while the direction of the deflection is controlled by the polarity of the average DC value. Thus, deflection of the LFM coil and armature can be controlled by changing the average DC value of the high frequency signal shown in FIG. 2*a* by changing its duty cycle through pulse width modulation of the signal. FIG. 2*b* shows such a pulse width modulated signal with an average DC value of −V1. The representation of a corresponding deflection force applied to the coil and direction of that force is shown in FIG. 2*c*, with the force having an amplitude of F1 to the left. FIG. 2*d* shows a pulse width modulated signal with an average DC value of −V2, which is correspondingly larger in magnitude than −V1. FIG. 2*e* shows the corresponding deflection force with a magnitude F2 to the left. Since −V2 has a larger negative amplitude than −V1, force F2 has a correspondingly larger magnitude than force Fl. FIG. 2*f* shows a pulse width modulated signal with a average DC value of +V1. FIG. 2*g* shows the corresponding force to the right with a magnitude of F1. Similarly, FIG. 2*h* shows a pulse width modulated signal with a duty cycle causing an average DC value of +V2. FIG. 2*i* shows the corresponding force to the right with a magnitude of F2. Therefore, the deflection of the LFM coil 54 and armature 46 is dependent upon the application of a high frequency signal to the LFM coil with an appropriate duty cycle selected for the desired deflection force and direction.

Figure 3:
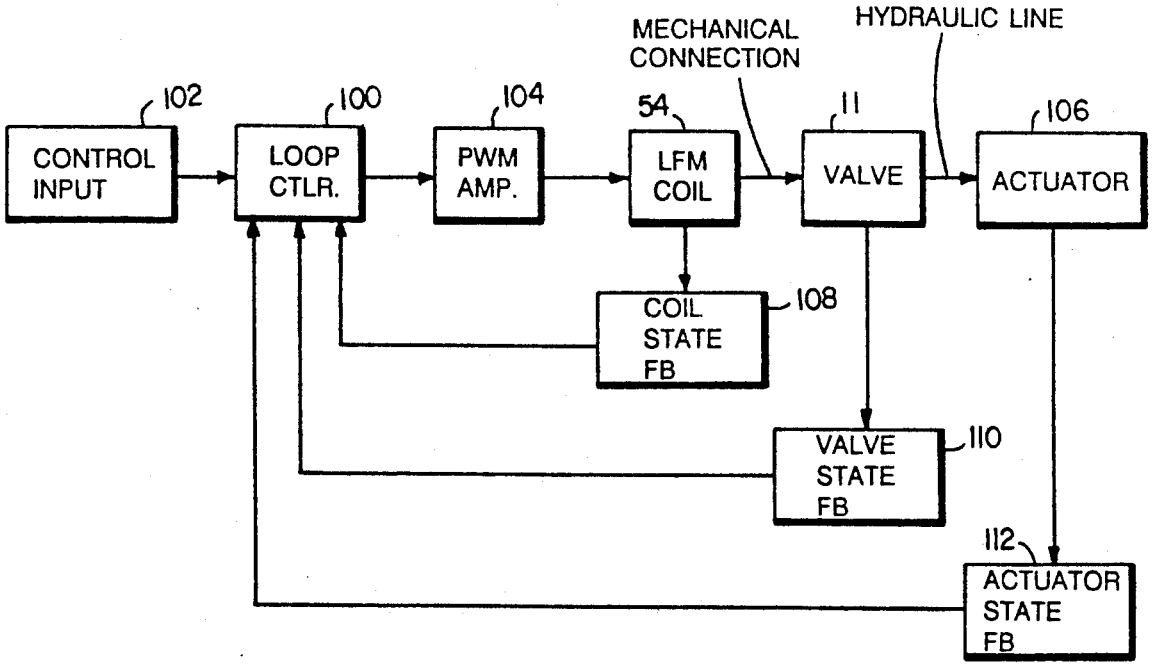
FIG. 3 is a block diagram schematic view of a servo control loop, for controlling the electrical excitation signal applied to the floating linear force motor of FIG. 1, showing a loop controller and various feedback elements.

A servo control loop used to control the displacement of the electrohydraulic valve is shown in FIG. 3. Generally, loop controller 100 receives control information indicating a desired operation of the hydraulic valve 11 through control input 102, and feedback information indicating the state of various elements (i.e. valve position) in the servo loop. Loop controller 100 modulates pulse width modulation (PWM) amplifier 104 which provides the high frequency excitation signal to the LFM coil 54, as described above, to deflect or maintain the position of the coil and operate valve 11 as required by the control input 102. In turn, valve 11 causes hydraulic pressure to operate an actuator 106 in a desired manner.

Feedback in the system may be taken from the coil 54, valve 11 or actuator 106 states. A coil state feedback device 108, is used to feedback the position of the LFM coil 54 within the LFM housing. Valve state feedback device 110 is used to feedback the state of the valve 11 by indicating the position of spool 44 within valve housing 42. Actuator state feedback device 112 may be used to feedback the state of the actuator 106, such as differential pressure applied to the actuator, velocity of actuator movement, position of the actuator, or force being applied by the actuator. Each of these feedback devices, 108, 110 and 112, are independent of the others and may stand alone in a system or be combined with the others, dependent on system requirements.

The design, operation and dynamics of electromechanical servo loops are well known in the art and will not be discussed in detail. It should be pointed out, however, that the frequency response of the servo loop discussed will most likely be limited, for practical purposes, by the inertial response of the physical elements: the LFM coil 54, armature 46, operating member 38 and spool 44. The loop controller 100, PWM amplifier 104 and feedback means 108 and 110 should in most cases have bandwidths well above the inertial bandwidth of the moving parts of the linear force motor 10 and the valve 11. Conversely, the actuator 106, and its feedback means 112 should in most cases have bandwidths below the bandwidth of the moving parts of the linear force motor 10 and the valve 11 due to the hydraulic coupling of the actuator 106 to the servo loop system.

Figure 4:
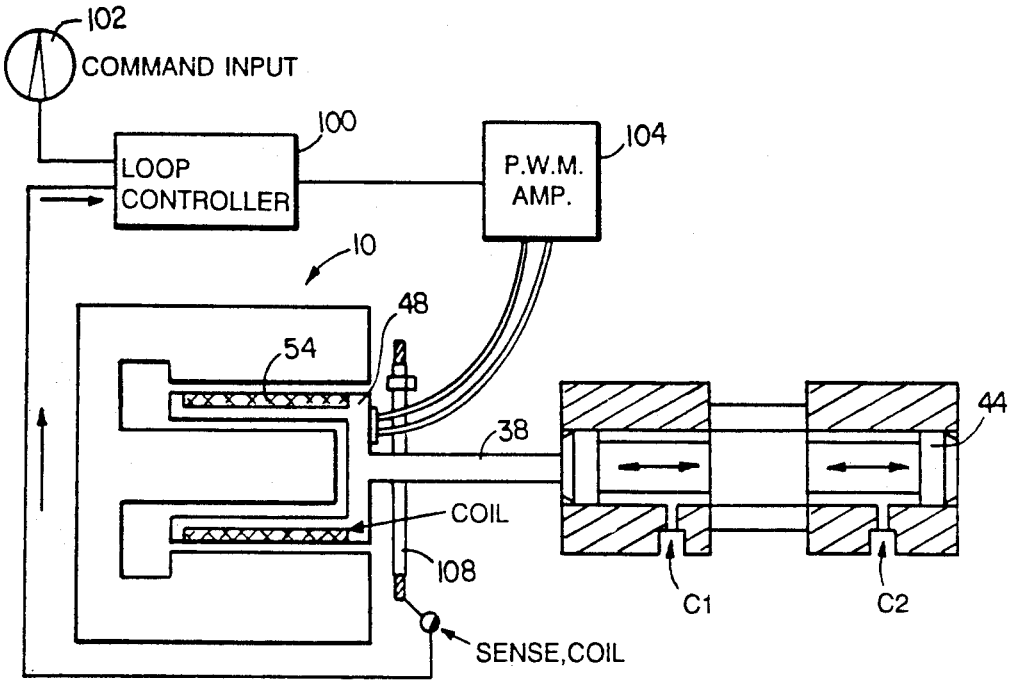
FIG. 4 is a schematic diagram of a servo control loop featuring a linear force motor coil position sense coil as a feedback element.

FIG. 4 shows a schematic diagram of a preferred embodiment of a servo control loop using a sense coil 108*a*, as an embodiment of LFM coil state feedback element 108 of FIG. 3, to feedback the position of the LFM coil 54 within LFM housing 12. Sense coil 108*a* is fixed in the LFM housing adjacent to LFM coil 54 to produce a feedback signal proportional to the changing peak to peak magnitude of the magnetic field of the LFM coil 54 as it approaches the sense coil 108*a*. The sense coil and LFM coil are close enough to be magnetically coupled. The duty cycle of the LFM coil does not affect the magnitude. In this manner, the position of the LFM coil 54 with respect to the sense coil 108*a* can be determined. Loop controller 100 uses the sense coil position information to modulate PWM amplifier 104 and thereby adjust LFM coil 54 position. Once the desired position of LFM coil 54 is attained, loop controller 100 causes the PWM amplifier to apply a 50 percent duty cycle excitation signal to the LFM coil.

Figure 5:
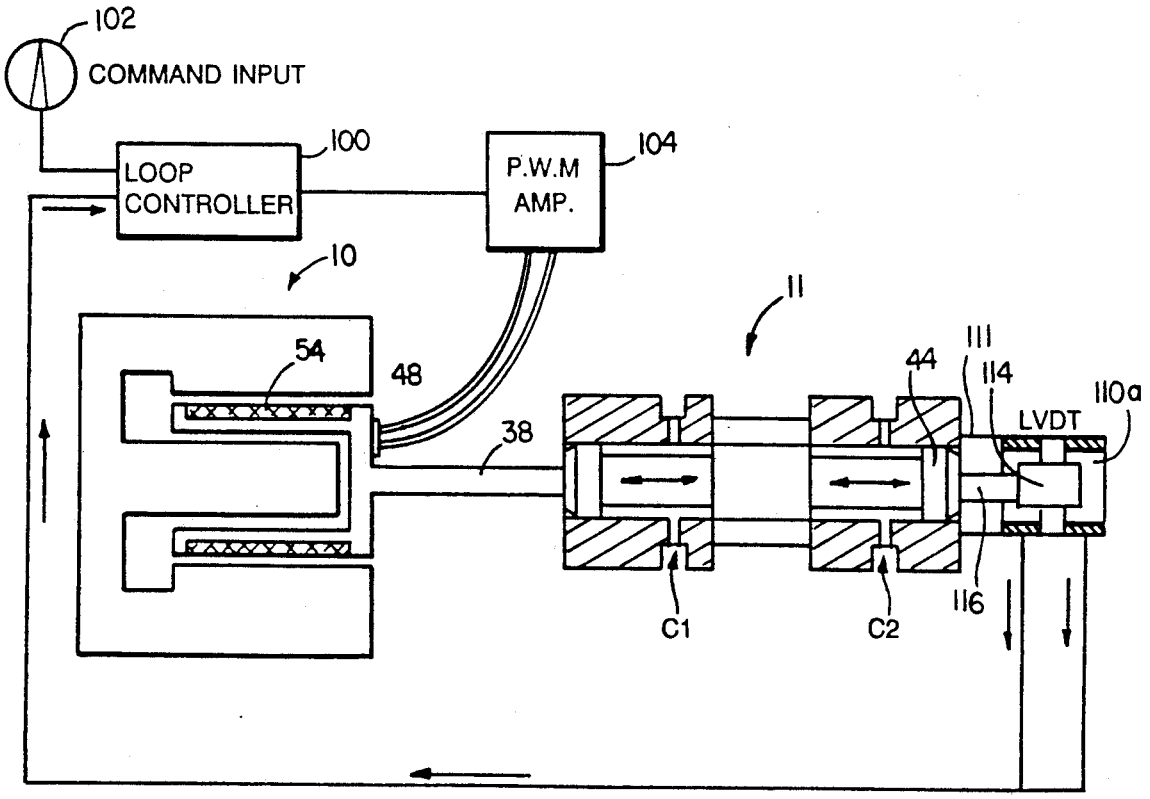
FIG. 5 is a schematic diagram of a servo control loop featuring a linear variable differential transformer as a feedback element to detect hydraulic valve position.

FIG. 5 shows a schematic of another preferred embodiment of the invention. Here, the valve state feedback element 110 of FIG. 3 is a linear variable differential transformer (LVDT) 110*a*. The body 111 of the LVDT is rigidly connected to the valve housing 42. The core of the LVDT 114 is connected by shaft 116 to the valve spool 44 so that linear displacements of the valve spool 44 are translated into linear displacements of the LVDT core 114. The LVDT produces a voltage feedback signal proportional to the position of core 114, and therefore, also proportional to the position of the valve spool 44 with respect to the valve housing 42.

Figure 6:
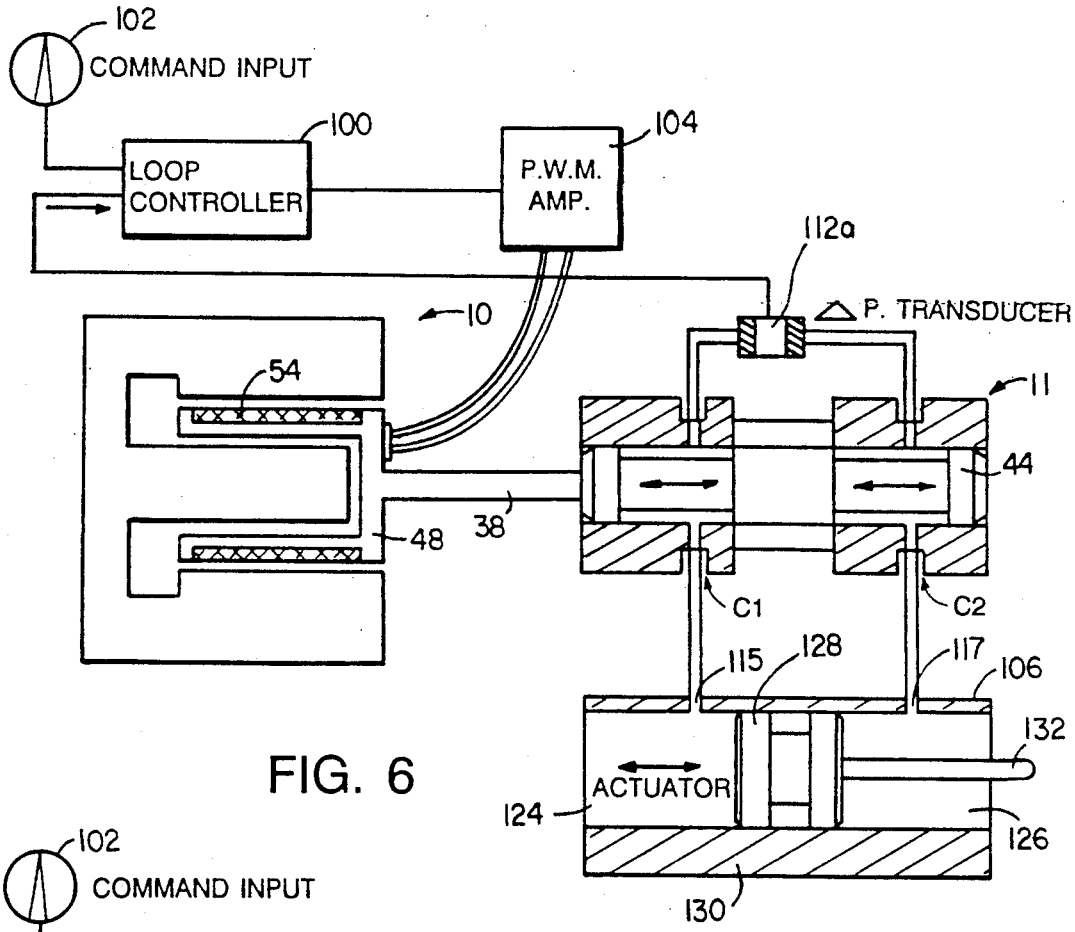
FIG. 6 is a schematic diagram of a differential pressure driven actuator connected to the hydraulic valve of FIG. 1, and a servo control loop featuring a differential pressure transducer as a feedback element to detect the differential pressure applied to the actuator.

FIG. 6 shows yet another preferred embodiment of the invention using a differential pressure transducer 112*a* as an actuator state feedback element 112 of FIG. 3. Pressure transducer 112*a* is connected across the valve control ports C1 and C2, and thus reads the pressure developed across the actuator 106 differential pressure inputs 115 and 117. Actuator 106 translates the differential hydraulic pressure between control port C1 and C2 into force that ultimately acts on some device (not shown). Control port C1 communicates with actuator chamber 124, and control port C2 communicates with actuator chamber 126. Actuator piston 128 is slidably within the actuator cylinder 130 in response to the differential pressure developed between chamber 124 and 126. Actuator arm 132 is connected to actuator piston 128 to communicate the force, velocity, and position of the actuator piston 128 to the device to be acted upon. The force, velocity or position of the actuator can be indirectly determined as a function of the measured difference in pressure between the two actuator pressures C1 and C2. Differential pressure transducer 112*a* detects the pressure difference between the two chambers 124 and 126, which is fed back to the Loop controller 100. In turn Loop controller 100 causes PWM amplifier 104 to drive the LFM coil 54, and thus operate valve 11, to obtain or maintain the desired pressure differential between chambers 124 and 126. A new desired differential pressure value may be input to the system through command input 106. In turn, loop controller 100 will operate the valve 11 to establish this new differential pressure in the actuator 106.

Figure 7:
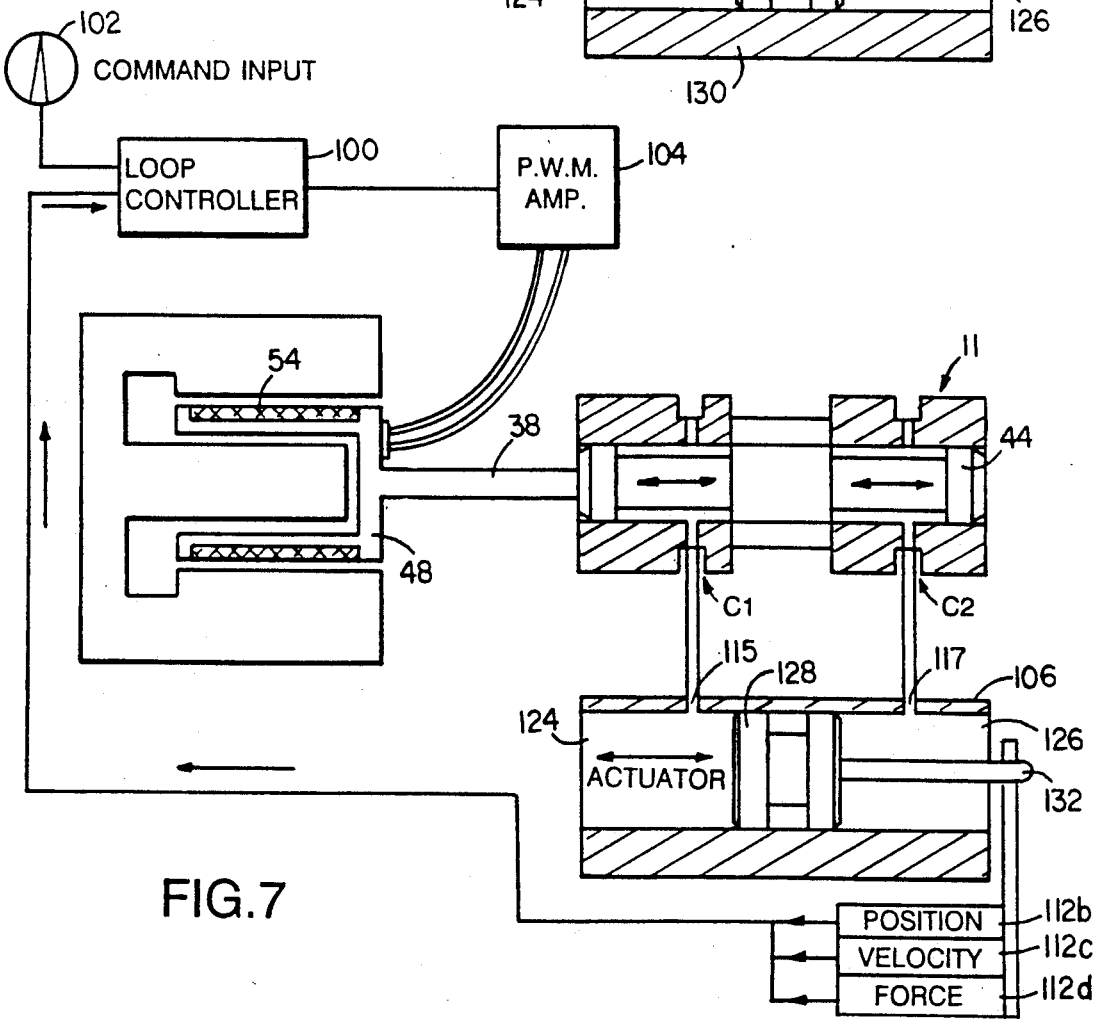
FIG. 7 is a schematic diagram of a differential pressure driven actuator connected to the hydraulic valve of FIG. 1, and an actuator position, velocity and force transducer as feedback elements to detect the respective parameters of the actuator.

FIG. 7 shows another preferred embodiment of the servo valve and actuator in the servo loop. In this embodiment position transducer 112*b*, velocity transducer 112*c*, and force transducer 112*d* feedback to Loop controller 100 the position, velocity, and force associated with the actuator arm 132. As in the previous embodiments described Loop controller 100 controls PWM amplifier 104 to cause valve 11 to operate in a manner causing actuator 106 to produce the desired position, velocity or force on actuator arm 132.

It is apparent from the discussion of FIGS. 3–7 that each of the control mechanisms may be essentially independent of the others. There are, however, advantages that may be obtained by combining one or more of the embodiments described in a single operational embodiment. For instance, the actuator based methods of feedback shown in FIGS. 5 and 6 have a lower frequency response than the valve spool positional types of feedback shown in FIGS. 3 and 4, but may provide higher accuracy operation of the actuator 106. As such, the overall characteristic of the feedback loop can be adjusted by combining the lower frequency response actuator based feedback and the higher frequency response positional based feedback. The availability of multiple feedback modalities with different frequency responses, accuracy, resolution, and specificity, creates a high degree of flexibility in the design and implementation of a high frequency response servo valve system.

Figure 8:
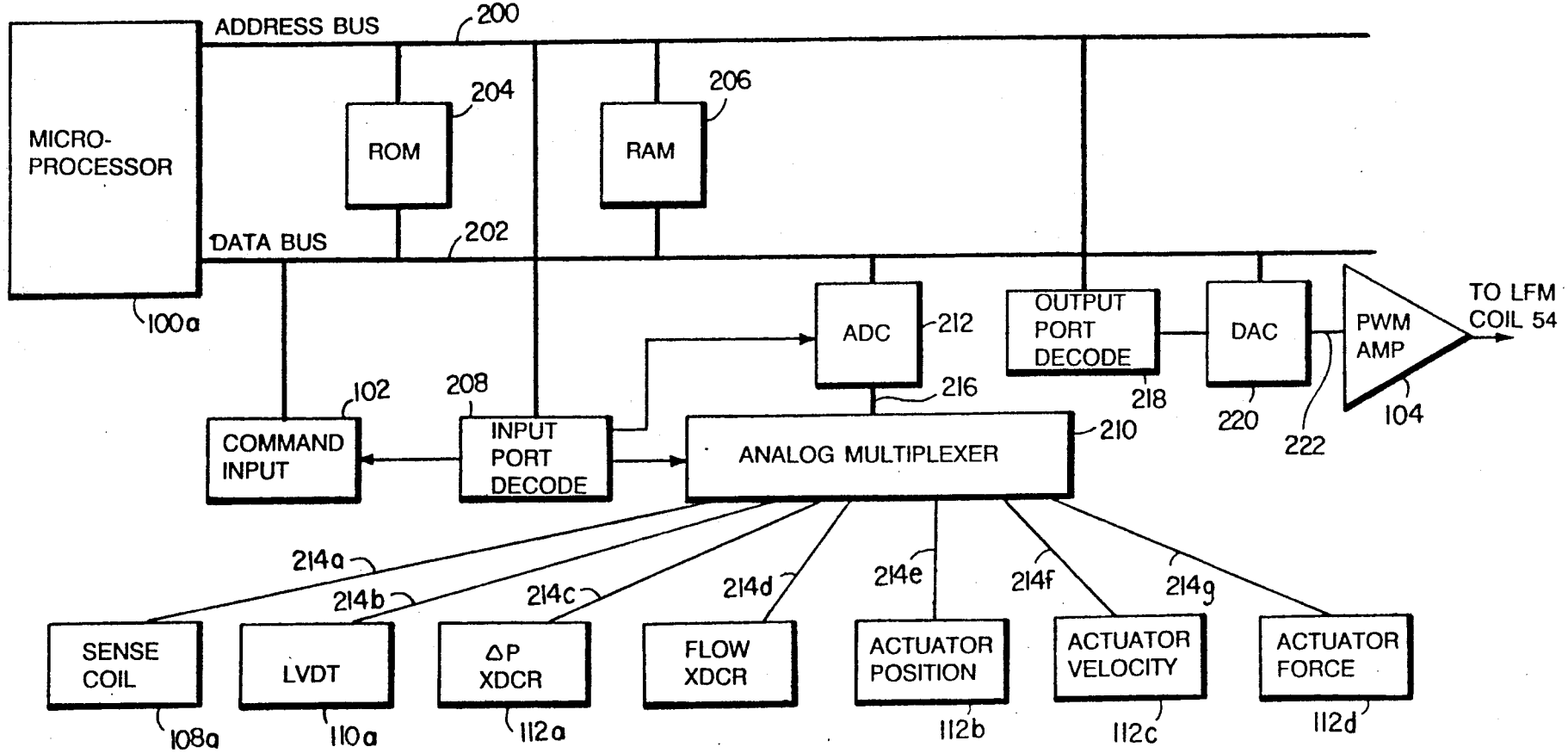
FIG. 8 is a schematic block diagram of a microprocessor servo loop controller showing the relationship of the various feedback elements and the pulse width modulation amplifier driving the floating linear force motor coil of FIG. 1.

FIG. 8 is a schematic block diagram of a preferred embodiment of the above described servo loop featuring a microprocessor loop controller 100*a*. The microprocessor 100*a* has a typical address bus 200, data bus 202, program ROM 204 and data RAM 206 associated with it. Peripheral input port decode 208 decodes the address bus 200 to enable microprocessor 100*a* to read data from various input devices. One such device is the command input device 102, which supplies microprocessor 100*a* with electrohydraulic valve commands. Another such device is the analog multiplexer (MUX) 210 and its associated analog to digital convertor (ADC) 212. Input port decoder 208 causes analog MUX 210 to select one of its multiple analog signal inputs 214*a*–214*g* at a time and apply the selected signal to ADC 212 via analog line 216. Simultaneously, input port decoder 208 enables the ADC 212 to convert the analog signal on analog line 216 to a digital value, and apply that digital value on the data bus 202 where it is read by microprocessor 100*a*. The analog input signals 214*a*–214*g* are derived from the various servo loop feedback devices discussed above, in particular the sense coil 108*a*, LVDT 110*a*, differential pressure transducer 112*a*, actuator position transducer 112*b*, actuator velocity transducer 112*c* and actuator force transducer 112*d*. As discussed above, any single feedback device or any combination of feedback devices may be used depending on the required application.

Peripheral output port decoder 218 decodes the microprocessor address bus 200 to enable microprocessor 100*a* to send a digital value to digital to analog converter (DAC) 220 to produce a PWM excitation signal on analog line 222. The PWM excitation signal on line 222 is in turn amplified by PWM amplifier 104 to drive the LFM coil 54 (not shown).

In one preferred embodiment, the microprocessor 100*a* chosen is of the digital signal processing (DSP) variety such as a Texas Instruments TMS320 family device. Program ROM 204 stores the program defining the servo control loop characteristic and the individual valve characteristic. There is no limit to the transfer function correlating command input signal level and valve response (e.g. position). The system can implement an "electronic cam" function via formula relationships or look up data tables. Based on the complexity of the servo loop program and the high speed of the TMS320 microprocessor devices, all the feedback devices can be sampled and the position of the electrohydraulic valve 11 can be accordingly adjusted approximately once every 1 ms.

An important advantage of the programmable servo loop and its ability to precisely control the high frequency valve 11 in response to system conditions, is that the valve operation in the system can be characterized and stored in the program ROM 204. Characterization of the valve permits manufacturing valves with production tolerances substantially wider than prior art devices, since wider tolerances can be compensated for by the programmable servo loop. For instance, prior art devices depend on nearly frictionless valve spool 44 to valve housing 42 operation to insure linear operation of the valve in response to an input excitation of the linear force motor. Typically the prior art valve spool and valve housing need to be surface matched within approximately 200 microns tolerance, for example. By characterizing each manufactured valve of this invention and dynamically compensating for friction automatically in the servo loop program, the surface tolerances of the valve spool and valve housing can be widened, for example, to approximately 400 microns, thereby significantly reducing the manufacturing cost of this invention over the prior art valve.

Another significant advantage of this invention over the prior art electrohydraulic valves is the replacement of centering springs in the linear force motor section with a "floating" LFM coil 54 driven by a PWM amplifier in a servo loop. The frequency response of the prior art servo valve is affected by the frequency response of the spring. The frequency response of the servo valve of this invention is greatly increased over the prior art since it is unaffected by any major resonances within the valve and motor. The removal of the spring from this invention increases the frequency response of the servo valve at least an order of magnitude beyond the prior art.

The foregoing description has been directed to specific embodiments for the purposes of illustration. Many variations and modifications designed for the same applications or other applications are possible without departing from the principles of the invention. Other embodiments are within the spirit and scope of the invention as claimed below.

What is claimed is:

1. A servo valve, comprising a magnet assembly defining an air gap containing a magnetic flux;

a coil support carrying an electrical winding in said air gap;

a spool valve comprising a spool slidably disposed in a spool valve housing;

operator means connected between said spool and said coil support to operate said spool valve by sliding said spool in said spool housing, said coil support, operator means and spool being free floating with respect to said magnet assembly;

electrical excitation means, connected to said electrical winding, for applying a bipolar electrical signal to said electrical winding, said electrical signal having a bipolar switching rate beyond the mechanical frequency response of said servo valve, and said electrical excitation means being responsive to a modulation signal to change the average DC value of said electrical signal.

2. The apparatus of claim 1 wherein said electrical excitation means includes a pulse width modulation amplifier.

3. The apparatus of claim 2 wherein said pulse width modulation amplifier has a carrier frequency in the range of 10 kHz to 50 kHz.

4. The apparatus of claim 2 wherein said carrier frequency range is 25 kHz to 35 kHz.

5. The apparatus of claim 1 further, comprising a least one feedback means for monitoring and communicating a condition of said servo valve via a feedback signal; and a servo loop controller, responsive to said feedback signal for supplying said modulation signal to said electrical excitation means, as a function of said servo valve condition.

6. The apparatus of claim 5 wherein said feedback means includes a position sensing means for sensing the position of said electrical winding.

7. The apparatus of claim 5 wherein said feedback means includes a sensor fixed relative to said magnet assembly adjacent to said electrical winding, said sensor producing an electrical signal dependent on the distance between said electrical winding and said sensor.

8. The apparatus of claim 5 wherein said feedback means includes a position sensing means connected to said spool of said spool valve, for sensing the position of said spool in said spool valve housing.

9. The apparatus of claim 8 wherein said second position sensing means includes a linear variable differential transformer, said transformer producing an electrical signal proportional to the position of said spool in said spool housing.

10. A servo valve connected to an actuator device for supplying differential hydraulic pressure to the actuator, the actuator having an actuator position, velocity and force dependent on the supply of differential hydraulic pressure to the actuator through the servo valve, comprising a magnet assembly defining an air gap containing a magnetic flux;

a coil support carrying an electrical winding in said air gap;

a spool valve comprising a spool slidably disposed in a spool valve housing;

operator means connected between said spool and said coil support to operate said spool valve by sliding said spool in said spool housing, said coil support, operator means and spool being free floating with respect to said magnet assembly;

electrical excitation means, connected to said electrical winding, for applying a bipolar electrical signal to said electrical winding, said electrical signal having a bipolar switching rate beyond the mechanical frequency response of said servo valve, and said electrical excitation means being responsive to a modulation signal to change the average DC value of said electrical signal;

a least one first feedback means for monitoring and communicating a condition of said actuator via a first feedback signal; and a servo loop controller, responsive to said first feedback signal for supplying said modulation signal to said electrical excitation means, as a function of said activator condition.

11. The apparatus of claim 10 wherein said first feedback means includes a position sensing means connected to said actuator for sensing the operational position of said actuator.

12. The apparatus of claim 10 wherein said first feedback means includes a force sensing means connected to said actuator for sensing the force applied by said actuator.

13. The apparatus of claim 10 wherein said first feedback means includes a velocity sensing means connected to said actuator for sensing the velocity of said actuator.

14. The apparatus of claim 10 wherein said first feedback means includes a pressure sensing means connected across said actuator inputs for sensing the hydraulic pressure applied through said spool valve to said actuator.

15. The apparatus of claim 10, further comprising at least one second feedback means for monitoring and communicating a condition of said servo valve, said servo loop controller responsive to said second feedback signal for supplying said modulation signal to said electrical excitation means, as function of said servo valve condition.

16. The apparatus of claim 15 wherein said second feedback means includes a position sensing means for sensing the position of said electrical winding.

17. The apparatus of claim 15 wherein said second feedback means includes a sensor fixed relative to said magnet assembly adjacent to said electrical winding, said sensor producing an electrical signal dependent on the distance between said electrical winding and said sensor.

18. The apparatus of claim 15 wherein said second feedback means includes a position sensing means connected to said spool of said spool valve, for sensing the position of said spool in said spool valve housing.

19. The apparatus of claim 18 wherein said position sensing means includes a linear variable differential transformer, said transformer producing an electrical signal proportional to the position of said spool in said spool housing.

20. The apparatus of claim 10 wherein said loop controller includes a microprocessor;

an electronic memory connected to said microprocessor;

data acquisition means connected to said microprocessor and to said first and second feedback means for receiving data from said first and second feedback means;

data output means connected to said microprocessor and to said electrical excitation means for modulating said electrical excitation means in response to said microprocessor; and command input means connected to said microprocessor for communicating commands to said microprocessor.

21. The apparatus of claim 20 wherein said microprocessor includes a digital signal processor.

* * * * *